United States Patent [19]

Clinch et al.

[11] 4,042,267

[45] Aug. 16, 1977

[54] SEALS

[75] Inventors: Colin W. F. Clinch; Peter A. R. James, both of Woodley; John H. Tibbett, Stansted, all of England

[73] Assignee: ITW Limited, Slough, England

[21] Appl. No.: 634,963

[22] Filed: Nov. 24, 1975

[30] Foreign Application Priority Data

Nov. 29, 1974 United Kingdom ..... 51700/74
Aug. 30, 1975 United Kingdom ..... 35842/75

[51] Int. Cl.[2] ..... B65D 27/30
[52] U.S. Cl. ..... 292/318; 24/30.5 P
[58] Field of Search ..... 292/318, 319, 320, 321, 292/324; 24/30.5, 16 PB, 17 R

[56] References Cited

U.S. PATENT DOCUMENTS

| | | | |
|---|---|---|---|
| 1,493,076 | 5/1924 | Hughes | 292/319 |
| 2,623,311 | 12/1952 | Condon | 292/320 |
| 3,501,814 | 3/1970 | Anderson et al. | 24/16 PB |
| 3,712,655 | 1/1973 | Fuehrer | 24/16 PB |
| 3,748,696 | 7/1973 | Martin | 24/16 PB |

FOREIGN PATENT DOCUMENTS

| | | | |
|---|---|---|---|
| 413,651 | 10/1946 | Italy | 292/318 |

*Primary Examiner*—Werner H. Schroeder
*Assistant Examiner*—Doris L. Troutman
*Attorney, Agent, or Firm*—Jack R. Halvorsen; Robert A. Beart

[57] ABSTRACT

Polythene bags are used to group together articles of clothing for transit. The invention relates to a security seal for use with such bags to prevent undetected transit theft. The seal according to the invention has two strip-like portions, which are formed with latching portions at points along the lengths of the strip-like portions. The seal is applied to the neck of the polythene bag, and during application the latching portions pierce the bag and pass through to engage in pairs with latching portions on the other strip-like portion. The latching portions have a weakened section, which breaks if the latching portions are urged out of engagement, thus a bag once sealed cannot be opened undamaged, as the seal will have broken latching portions indicating to a checker at the destination that the bag has been interfered with.

11 Claims, 15 Drawing Figures

SEALS

The invention relates to seals, in particular security seals for polythene bags.

In the clothing industry, garments are transported on conventional coathangers, hung from racks in road vehicles. Usually, the coathangers are suspended from returnable metal hanging brackets, and, to facilitate unloading, garments to be delivered at the same destination are put on the same bracket. It is fairly general practice to allocate rack space in standard lengths, corresponding to the length of a bracket, each length accommodating a bracket from which are suspended a number of coathangers, the number depending on the type and thickness of the garments carried.

The garments suspended from each bracket are called a 'set', and are protected during transit by being encased in a polythene bag, which is passed upwards on to the garments and gathered at the top about the stems of the coathanger hooks. The bag is then either knotted about itself or bound with adhesive tape of a kind readily available.

Illicit opening of the bag during transit is easy, as all that has to be done is to untie or untape the bag, remove the bag from the garments, and remove from the set one or two garments complete with hanger(s). The bag can then be replaced, reknotted or resealed. The detection of illicit entry to a set, and where this has taken place, (packing, transit, or destination) has hitherto been very difficult, in spite of set identification labels.

The present invention concerns the production and use of a security seal for a set of garments, which will allow a checker to ascertain whether or not the set has been tampered with. The set seal prevents unauthorised removal of garments, and a shortage from the labelled quantity, if the seal and bag are unbroken, indicates short shipment. Damage to the bag or set seal, however, signifies transit theft. A secondary purpose of the seal is to exclude dust and dirt from the bag enclosing the garments.

A seal according to the present invention comprises two strip-like portions adapted to be secured together by means of pairs of co-operating latching portions, the latching portions being disposed along the lengths of the strips in such a way that when the strips are brought together at least one pair of the latching portions forms a non-return restraint, and includes a weakened section preventing the two strip-like portions of the seal from being separated undamaged.

Preferably, the two strips are formed with identical male and identical female latching portions, and are hinged together at one of their respective ends, allowing the strips to be rotated into an operating position in which the male latch members enter the female latch members to secure the strips together.

The latching portions on the strips may be of distinct, complementary male and female types, or may all be identical.

Alternatively, the strips may be formed separately, in such a way that two identical strips, each having an equal number of male and female latching parts, may be secured together to form a seal.

Advantageously, the strips may be formed with a grip portion at one end to allow easy removal of the seal when required.

The latching portions may also advantageously be protected from tampering by a shroud surrounding the latching portions, the shroud preventing access to the latching portions when engaged.

The male latching portions formed on the strips may each comprise a conical tip portion supported by a number of radial ribs, extending from the base of the conical tip portion and integral therewith. The ribs are integral at their ends remote from the conical tip portion with the surface of a bore in one of the strip portions, and this connection forms the weakest part of the latching member. The ribs are preferably symmetrically disposed about the axis of the conical tip portion.

The female latching portions may comprise an aperture in a strip portion positioned to co-operate with a male latching member, a tubular shroud encircling the aperture and extending from the strip portion, and a number of symmetrically disposed wings situated on the inner surface of the shroud or the aperture, the wings extending obliquely from the shroud or aperture and converging in the direction of entry of the male latching portions, the wings and ribs of the female and male latching portions being disposed such that after the conical tip portion of the male latching portion has entered the female latching portion, and passed the free edges of the wings, the edges of the wings engage the base of the conical tip portion to prevent withdrawal of the male latching portion.

Two embodiments of the present invention will now be described with reference to the accompanying drawings, in which.

Figure 1:
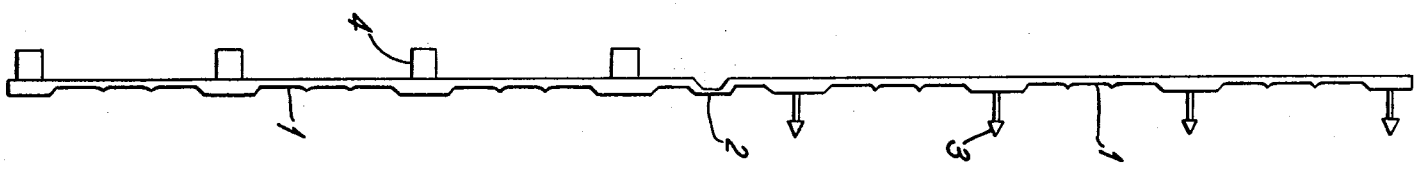
FIG. 1 shows a set seal according to a first embodiment of the invention.
Figure 2:
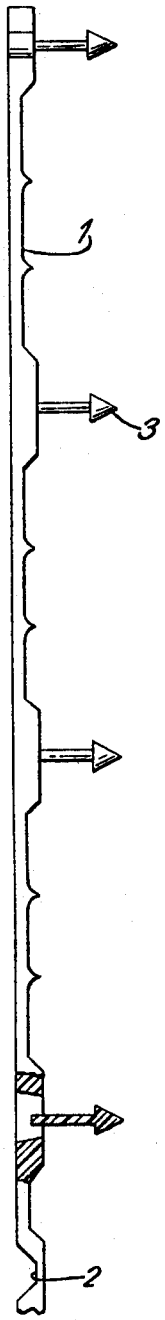
FIG. 2 is a part side elevation, showing one strip of a set seal incorporating two hinged strips.
Figure 3:
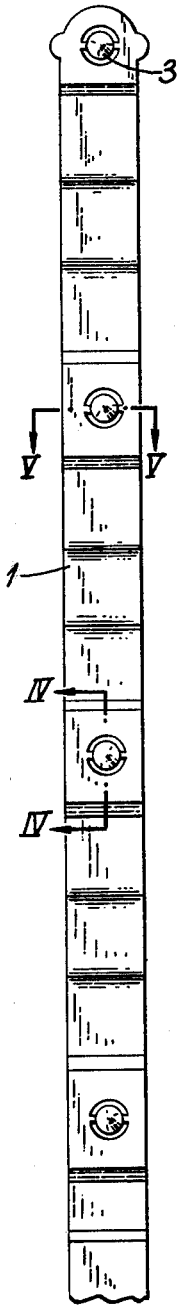
FIG. 3 is a plan of the part shown in FIG. 1, showing the male latching members.

Referring to FIGS. 1 to 9, the seal consists of two strip portions 1, joined by a hinge 2. The strip portions have male and female latching portions 3 and 4, respectively, distributed along them in such a way that when the strips 1 are brought together by rotation about the hinge 2, the top part of the seal rotating clockwise as seen in FIG. 1, each male latching portion 3 enters a female latching portion 4.

Figure 8:
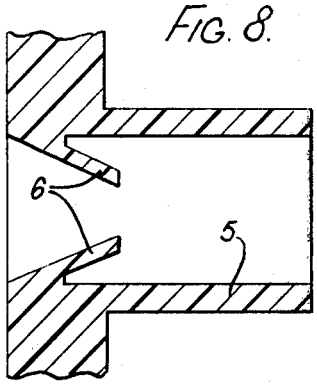
FIG. 8 is an enlarged section along the line VIII—VIII in FIG. 7.
Figure 9:
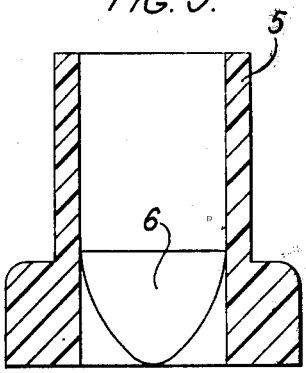
FIG. 9 is an enlarged section along the line IX—IX in FIG. 7.
Figure 10:
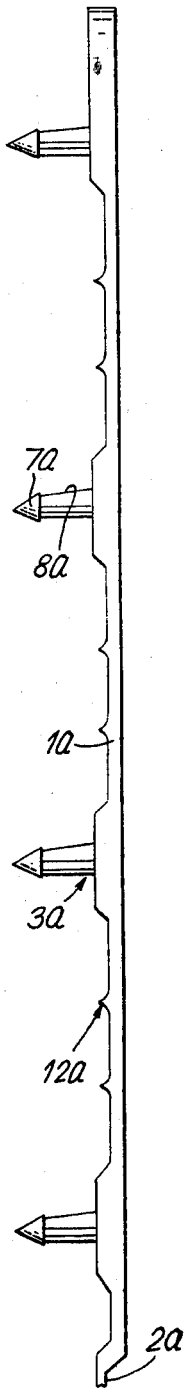
FIG. 10 is a part side elevation similar to FIG. 2 of a second, preferred, embodiment of the invention.
Figure 11:
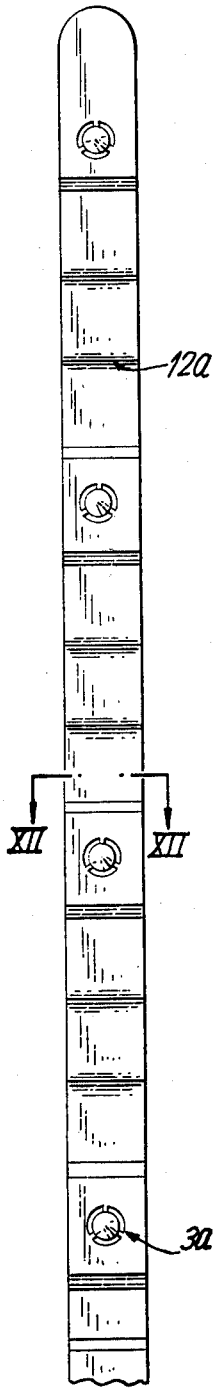
FIG. 11 is a plan view of the part shown in FIG. 10.

Each female latching portion 4 includes a shroud 5, and two flexible wings 6, seen in FIGS. 8 and 9, which converge in the direction of entry of the male latching portion 3.

Figure 4:
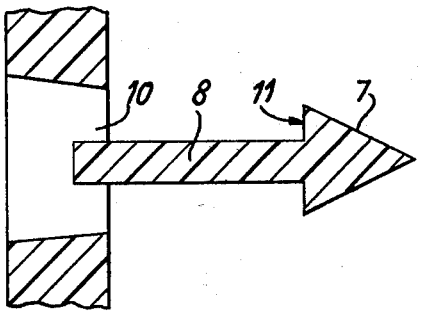
FIG. 4 is an enlarged section along the line IV—IV in FIG. 3.
Figure 5:
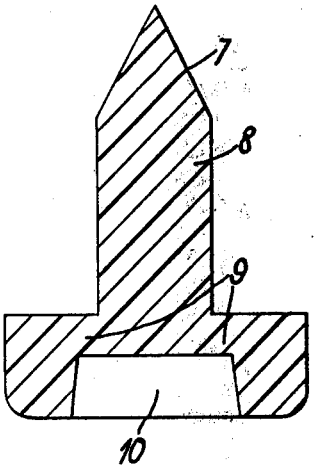
FIG. 5 is an enlarged section along the line V—V of FIG. 3.
Figure 7:
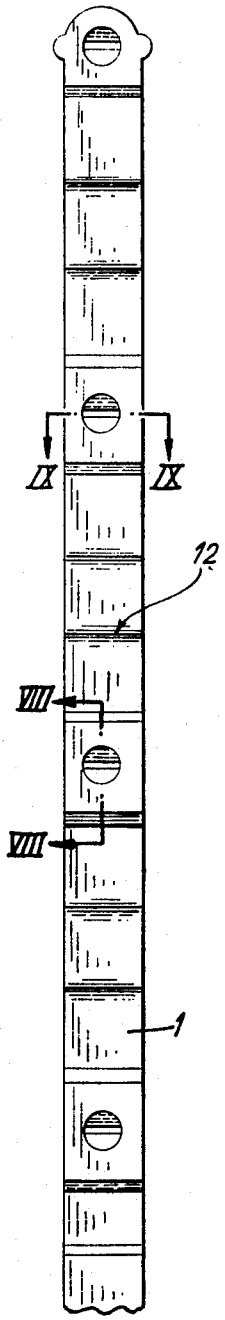
FIG. 7 is a plan of the strip shown in FIG. 6.
Figure 6:
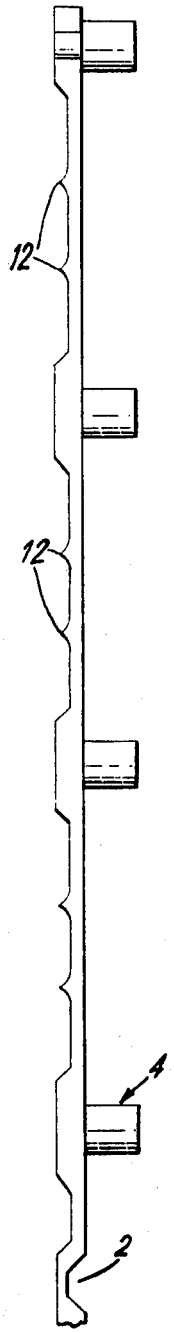
FIG. 6 shows the other strip of the set seal shown in FIG. 1, in side elevation.

Each male latching portion 3 includes a conical tip 7 and a substantially planar shank 8, seen in FIGS. 4 and 5, the shank being joined to the strip-like portion by webs 9 situated in a bore 10.

To seal the bag, the bag is gathered round the stems of coathanger hooks, and a seal is snapped over the bag and the hook stems, whereupon the conical tips 7 of the male latching portions pierce the bag and then enter the female latching portions 4. On entry, each conical tip 7 forces the wings 6 in a female latching portion back against the walls of its shroud 5, the wings resiliently springing back after the tip 7 has passed them to bear on the base 11 of the conical tip of the male latching portion. This prevents withdrawal of the male latching portion from the female latching portion. The lateral ridges 12 serve to locate the stems of the coathanger hooks, and reduce movement during transit, especially if a set is composed of thin garments.

Referring now to FIGS. 10 to 15 of the drawings, there is shown a second, preferred, embodiment of the invention, in which the two strips 1*a* are joined by a hinge portion 2*a*. The female latching portions 4*a* each include a shroud 5*a*, and three flexible wings 6*a* which converge in the direction of entry of the male latching portion 3*a*, shown by arrow 'X' in FIG. 13.

Figure 12:
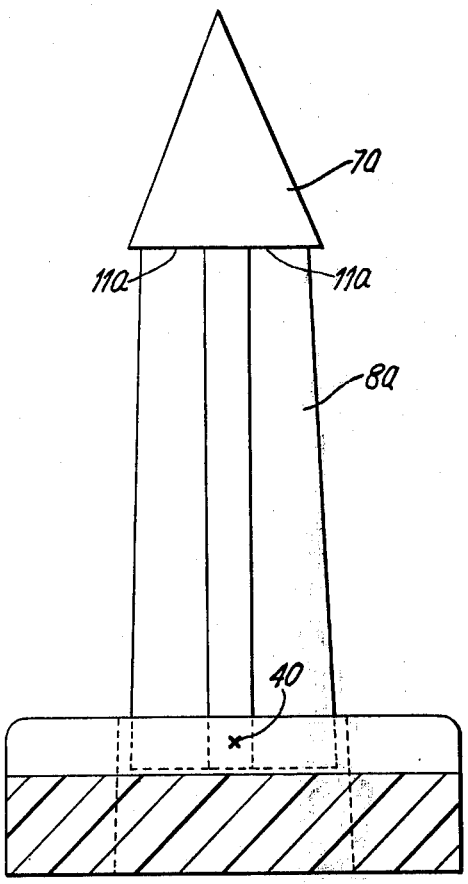
FIG. 12 is an enlarged sectional view along the line XII—XII of FIG. 11.

The male latching portion 3*a* has a conical tip 7*a* and three ribs 8*a* extending from the base of the tip 7*a*, the ribs being integral with the strip portion 1*a* at areas 40, shown in FIG. 12.

To seal a bag containing a set of garments, the bag is first gathered round the stems of the coathanger hooks as previously described, and a seal is snapped over the bag and the hook stems, whereupon the conical tips 7*a* of the male latching portions 3*a* pierce the bag, and then enter the female latching portions 4*a*. On entry, each conical tip 7*a* forces the three wings 6*a* in a female latching portion back against the walls of its shroud 5*a*, the wings resiliently springing back after the tip 7*a* has passed them to bear on the shoulders 11*a* of the male latching portion, shown in FIG. 12. This prevents withdrawal of the male latching portion from the female latching portion. The lateral ridges 12 and 12*a*, on strips 1 and 1*a* respectively, serve to locate the stems of the coathanger hooks, and reduce movement during transit, as previously stated.

The frangible ribs 8 and 8*a*, respectively, serve to frustrate illicit entry, in that when the seal is opened the ribs fracture at the points where they join the strip portions 1 and 1*a*, leaving the male latching portions inside the shrouds 5 and 5*a* of the female latching portions 4 and 4*a*. This allows the checker during transit and/or at the final destination to determine immediately whether the set has been tampered with, as the seal or bag will be damaged. Thus it will be possible to differentiate between sets which have been wrongly packed, and sets which have been tampered with in transit.

Other embodiments of the invention are possible, in that the two strip portions may be identical, with like numbers of male and female latching portions on each strip portion, the latching portions arranged to mate when the seal is closed.

Embodiments of the invention in which each latching portion is identical to all other latching portions are foreseen.

The two strips may be moulded as a single unit, or may be made separately and assembled as a separate operation.

Preferably, the hinge portion 2 and a small joining tab (not shown) are moulded integrally with one of the strips, and the other strip is subsequently welded to the joining tab to form a complete seal.

Figure 14:
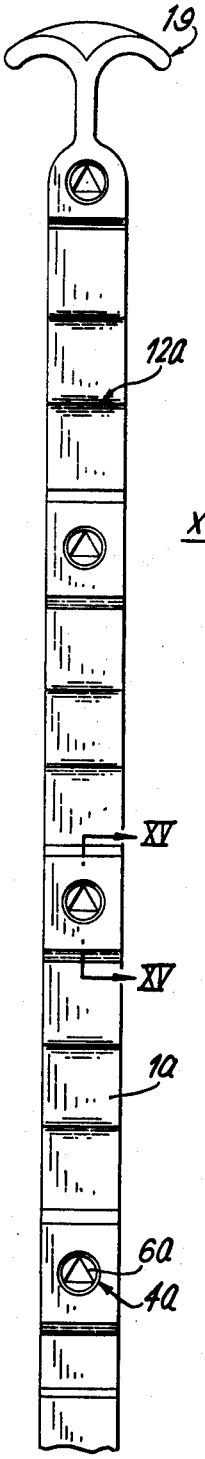
FIG. 14 is a plan of the part shown in FIG. 13.
Figure 13:
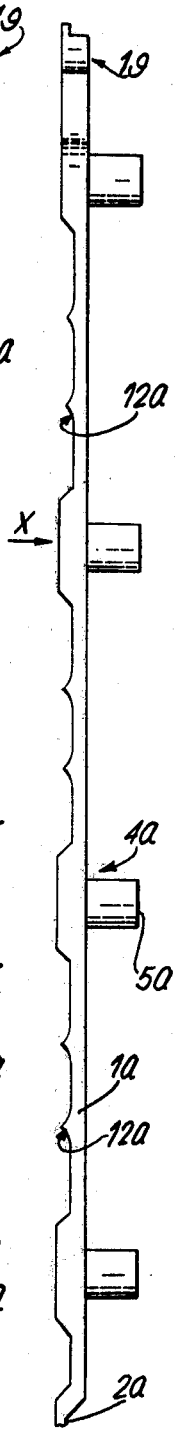
FIG. 13 is a side view similar to FIG. 6, showing the strip corresponding to that shown in FIG. 10.
Figure 15:
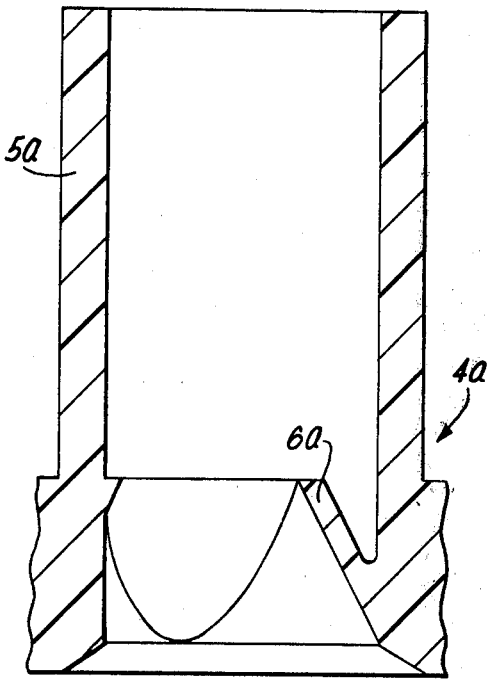
FIG. 15 is an enlarged section on the line XV—XV of FIG. 13.

Grips 9, shown in FIGS. 13 and 14, may be moulded on to the ends of one or both of the strips remote from the hinge, to facilitate removal of the seals. In the case of a seal made up of two identical strips, the grips 9 may be formed at one end or at both ends of each strip.

The seals may be coloured and/or numbered, to ensure security.

Preferred materials for seals of this type are polypropylene, high density polythene, nylon, or any other substantially rigid thermoplastic material suitable for injection moulding.

As an alternative to the embodiments described above, a set seal may be formed as two strip-like portions having frangible, non-releasable latching portions, as hereinbefore described, at the ends of the strips only. Intermediate the lengths of the strips there may be releasable fastening devices securing the strips together such as press studs, of a type well known in the snap-fastening art. These fasteners prevent the frangible latching portions from being broken in normal use.

In set seals of this type, it is the frangible latching portions at the ends of the strip which indicate whether the set has been tampered with or not. The two strip-like portions of a seal of this type may be hinged together at one end, and then there need only be one frangible latching portion at the end of the seal remote from the hinge.

We claim:

1. A tamper-proof security seal for sealing the open end of garment bags in transit, said seal having two strip-like portions and a plurality of pairs of complimentary male and female latching portions, said latching portions being formed at positions spaced along the lengths of said strip-like portions and extending perpendicularly to said strip-like portions, said latching portions being adapted so that when said strip-like portions are brought together in juxtaposed relation that at least one of said pairs of said latching portions engages to form a non-return restraint, said male latching portions including a stem and an enlarged head with said stem at its end remote from said enlarged head being connected to said strip-like portion by a frangible weakened section, said section having a predetermined strength capable of withstanding the forces necessary to latch the male portion within the female portion but which will break if said latching portions are urged out of engagement, thereby preventing the two strip-like portions of said seal from being separated undamaged without detection.

2. A seal according to claim 1 in which each said male latching portions has its stem positioned within a bore through one of said strip-like portions on which it is formed, each male latching portion being an elongated member having a conical tip portion and a stud-like portion formed by a number of axially extending planar ribs, a like number of thin frangible webs joining said planar ribs to the wall of said bore which extends through said strip, said conical tip portion being supported in spaced relation to said strip by said ribs with the axis of said conical tip being perpendicular to said strip-like portion, said ribs extending from the base of said conical tip portion and terminating within said bore through said strip-like portion, said thin webs having a predetermined strength which will permit latching of the female latching portion with said male latching portion but said webs being fractured by a force less than the force required if said latching portions are urged out of engagement, said female latching portions each including a bore through said strip-like portion on which it is formed and a number of flexible, substantially planar wings, said wings extending obliquely from the wall of said bore and converging in the direction of entry of said male latching portion, said wings being at least three in number and joined through a substantial portion of their adjacent edges to form a resilient capturing socket for the enlarged head.

3. A seal according to claim 1, in which the two said strip-like portions are hinged together at one of their respective ends.

4. A seal according to claim 1, in which the two said strip-like portions are separate and identical, each having an even number of said latching portions disposed along its length in such a way that symmetrical positions about the centre of each said strip-like portion are occupied by complementary latching portions.

5. A seal according to claim 1, in which said latching portions on one of said strip-like portions are all identical.

6. A seal according to claim 1, in which said latching portions are of identical male and complementary identical female types, said seal including like numbers of male and female latching portions disposed such that when said strips are brought together each said male latching portion enters a said female latching portion to secure the strip-like portions together.

7. A seal according to claim 2, in which the number of said ribs in each of said male latching portions is equal to the number of said wings in each of said female latching portions.

8. A seal according to claim 7, in which the number of said ribs and wings is greater than 1 and less than 4.

9. A seal according to claim 1, in which one of the two said strip-like portions has a tab formed thereon to facilitate separation of said strips after use.

10. A seal according to claim 1, in which each said strip-like portion and said latching portions formed thereon are an integral moulding of a plastics material.

11. A seal according to claim 2, in which the two said strip-like portions and said respective latching portions are integral plastics mouldings, and are integrally joined by a hinge portion of said plastics material.

* * * * *